US006388398B1

(12) United States Patent
Li et al.

(10) Patent No.: US 6,388,398 B1
(45) Date of Patent: May 14, 2002

(54) MIXED MODE CONTROL FOR BALLAST CIRCUIT

(75) Inventors: Qiong Li, Cortlandt Manor; Ihor Wacyk, Briarcliff Manor, both of NY (US)

(73) Assignee: Koninklijke Philips Electronics N.V., New York, NY (US)

( * ) Notice: Subject to any disclaimer, the term of this patent is extended or adjusted under 35 U.S.C. 154(b) by 0 days.

(21) Appl. No.: 09/812,439

(22) Filed: Mar. 20, 2001

(51) Int. Cl.[7] ..... G05F 1/00

(52) U.S. Cl. ..... 315/307; 315/224; 315/194; 315/246; 315/247

(58) Field of Search ..... 315/307, 291, 315/297, 310, 311, 246, 247, 251, 224, 225, 194, 196

(56) References Cited

U.S. PATENT DOCUMENTS 5,583,402 A * 12/1996 Moisin et al. ..... 315/307
6,081,077 A * 6/2000 Canova et al. ..... 315/307
6,316,888 B1 * 11/2001 Raiser ..... 315/307

* cited by examiner

*Primary Examiner*—Don Wong
*Assistant Examiner*—Tuyet T. Vo
(74) *Attorney, Agent, or Firm*—Steven R. Biren

(57) ABSTRACT

A ballast system in which mixed-mode gate signals are used to control the ballast circuit so as to produce a more straight ballast lines such than only a single solution exists between ballast lines and lamp lines over the whole operating range, whereby a stable of lamp performance is achieved. In a preferred embodiment, symmetric and asymmetric modes are arranged alternatively in every other switching cycle to produce mixed-mode PWM gate signals.

16 Claims, 5 Drawing Sheets

MIXED MODE CONTROL FOR BALLAST CIRCUIT

TECHNICAL FIELD

This invention relates to a ballast, and more particularly, to an improved apparatus and method for controlling a ballast to drive various types of lamps and produce stable performance of the lamps over a large operating range.

BACKGROUND OF THE INVENTION

A ballast is a device with a switched mode circuit and is often used to drive lamps, especially high intensity discharge (HID) lamps. As an example, a ballast may be implemented as a half-bridge ballast circuit 1 shown in FIG. 1. Switches 11 and 12 are turned on and off by applying appropriate gate voltages thereon for producing a stable driving voltage to the lamp or lamps 10.

The gate voltages are activated and deactivated by gate signals sent from a controller 2 which generates the gate signals and sends them to the ballast circuit 1. This is illustrated in FIG. 2, which shows a general block diagram for a ballast circuit 1. In all the circuits for a specific operation, a fixed single-mode gate signal pattern is generated at each switching cycle by the controller 2 and sent to the ballast circuit 1 for controlling the on or off state of the switches 11 and 12. Pulse width modulation (PWM) or frequency modulation has been used in ballast circuits to regulate the power delivered to the lamp. Two major pulse width modulation (PWM) patterns used are symmetric mode (FIG. 3*a*) and asymmetric mode (FIG. 3*b*). Either way, only a single mode is used. The single-mode control is simple and effective for most of the applications.

As competition increases in the market, more and more functionality and capacities are required in a single ballast circuit, such as universal line input and larger range of load. These requirements are difficult to meet using single mode control. For example, in a universal lamp dimmable ballast system, a single mode PWM control is very difficult to stabilize due to the large variations of lamp characteristics for different temperatures and lamp types. This is explained in more detail with reference to FIGS. 4*a* and 4*b*, the diagrams of the impedance lines of the ballast and the lamps.

A stable system requires only one single stable solution between the ballast lines and the lamp lines over the whole lamp operation range. However, this sometimes can not be achieved with a single mode control. As shown in FIG. 4*a*, the ballast lines with fixed duty cycles in symmetric mode control and two types of lamp lines are superimposed. Multiple solutions are shown with one particular duty cycle, which are marked as points A, B and C on the impedance line of lamp type T5-14W. In FIG. 4*b*, which shows the same case but in asymmetric mode control, two solutions, marked as points A and B on the impedance line of lamp type T5-80W, are shown with one particular duty cycle. Thus, an oscillation between the two solutions will occur.

In view of the above, there exists a need in the art for a universal ballast system that solves the instability problem as stated above so that all the lamps may perform stably over the whole lamp operation range.

SUMMARY OF THE INVENTION

The above problem of the prior art is overcome in accordance with the teachings of the present invention, which relates to a ballast system with a novel control technique. The controller for the ballast circuit generates and transmits gate signals that are of mixed modes. In particular, the gate signals are of a first mode in some switching cycles to cause the ballast circuit to produce concave ballast impedance curves, and are of a second mode in other switching cycles to cause the ballast circuit to produce convex ballast impedance curves. Combinations of these two modes results in relatively straight ballast curves, especially at a lower voltage region, whereby only a single solution exists between the ballast lines and lamp lines over the whole operation range.

Preferably, the gate signals are pulse width modulation (PWM) signals, and the first mode is symmetric mode while the second mode is asymmetric mode, which are arranged alternatively in every other one of the switching cycles.

BRIEF DESCRIPTION OF THE DRAWINGS

The features and advantages of the present invention can be understood more clearly by reading the following detailed description of a preferred embodiment with reference to the accompanying drawings in which.

DETAILED DESCRIPTION OF THE PREFERRED EMBODIMENT

Figure 1:
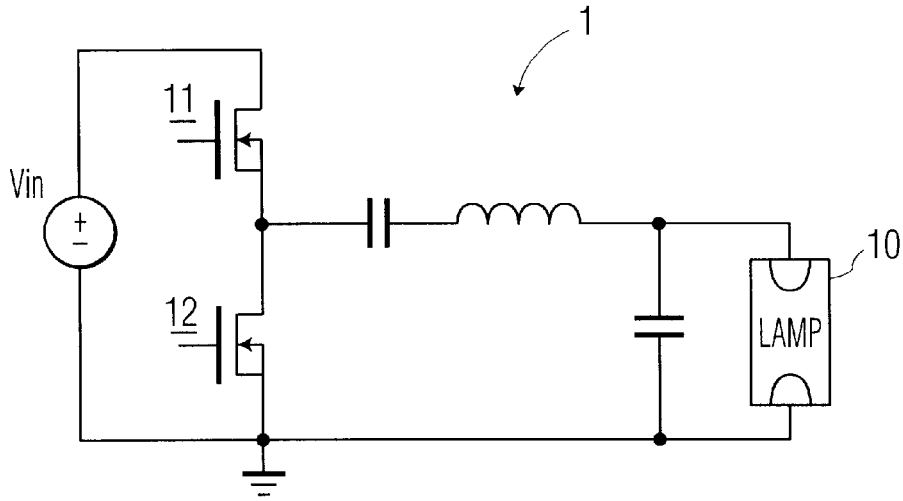
FIG. 1 is a half-bridge ballast circuit diagram.
Figure 2:
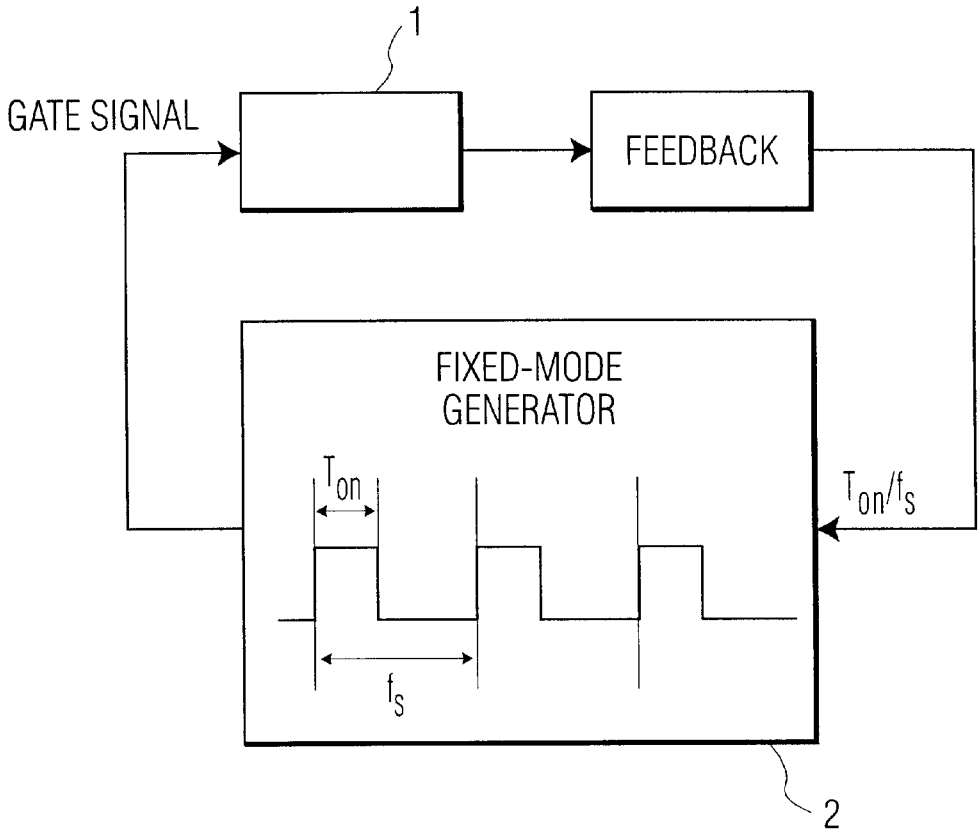
FIG. 2 is a general block diagram for the ballast circuit in FIG. 1 and the controller.
Figure 3A:
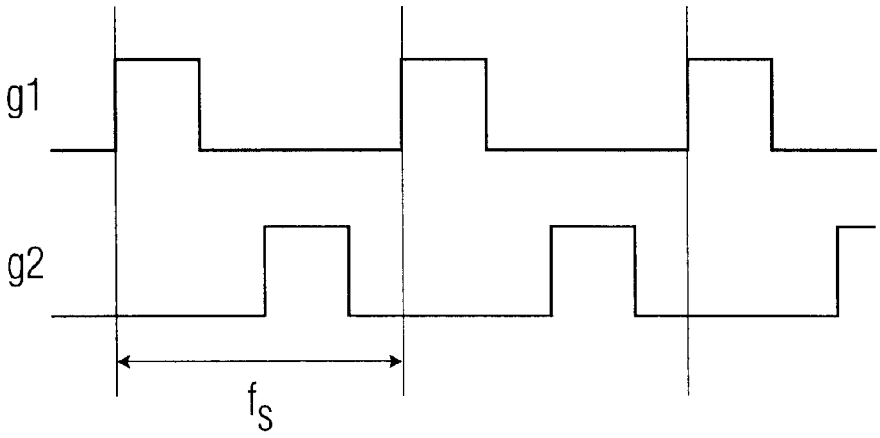
FIG. 3*a* shows symmetric mode PWM gate signals.
Figure 3B:
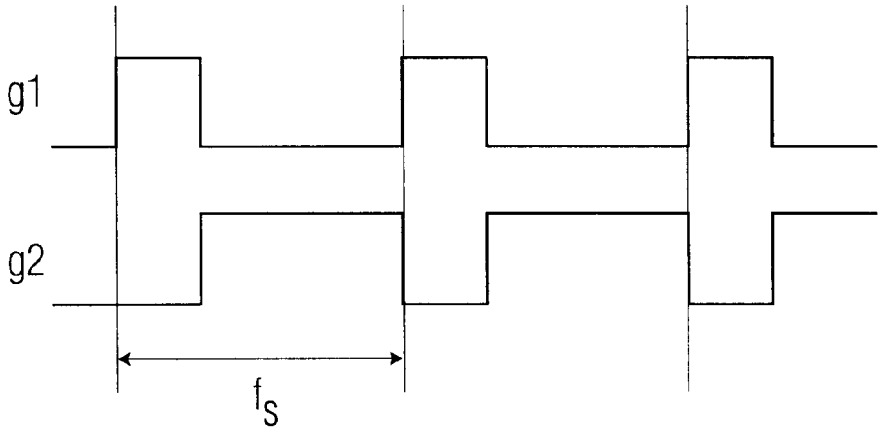
FIG. 3*b* shows asymmetric mode PWM gate signals.
Figure 4A:
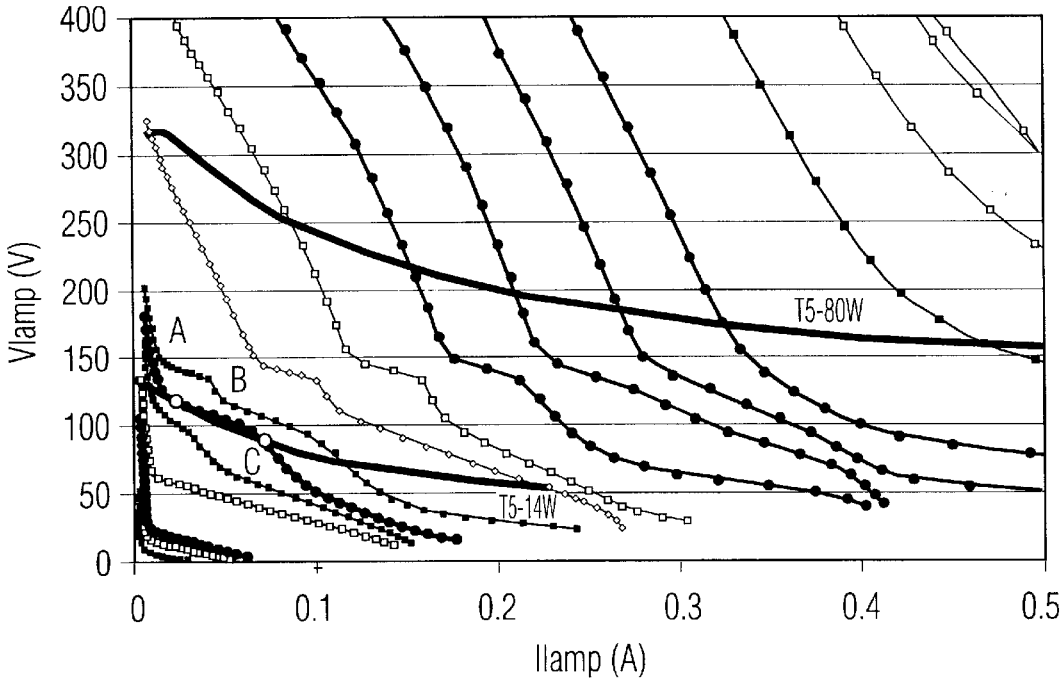
FIG. 4*a* shows ballast lines and lamp lines in symmetric mode control.
Figure 4B:
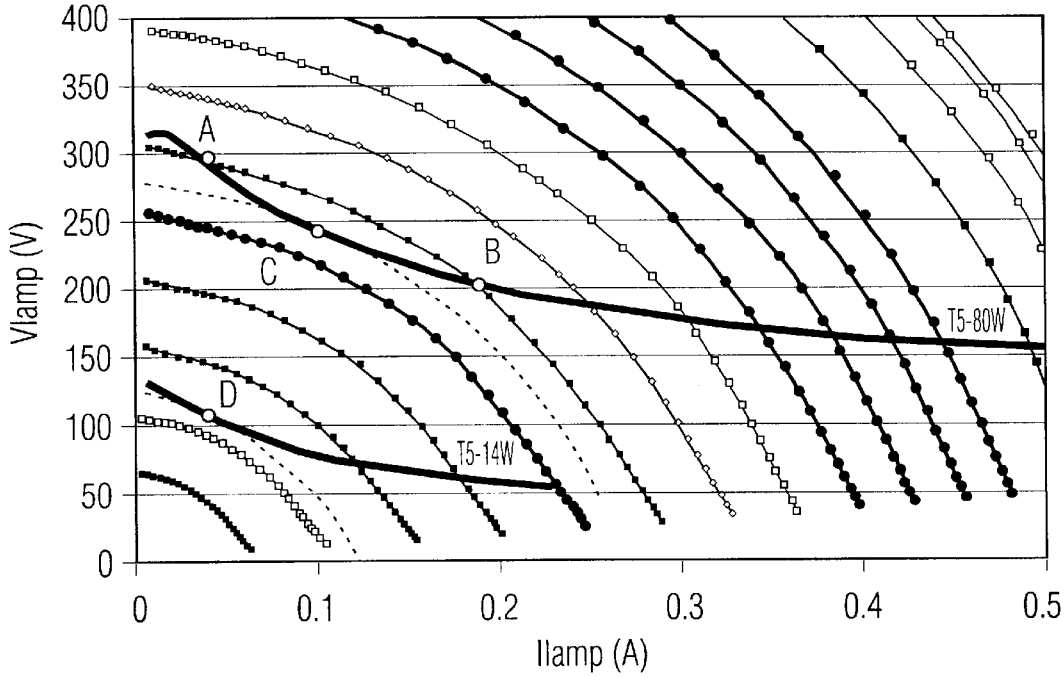
FIG. 4*b* shows ballast lines and lamp lines in asymmetric mode control.

As can be seen from FIGS. 4*a* and 4*b* for the ballast circuit under single-mode control, the symmetric mode control produces concave ballast curves. The curves are too flat and irregularly curved in the low voltage region. The asymmetric mode control produces convex ballast lines as in FIG. 4*b*, but the curves are steeper in the low voltage region. Multiple solutions exist in this low voltage region on both sets of curves as shown.

According to the present invention, different modes are combined together to produce a mixed-mode control which will result in flat ballast line curves such that only a single solution exists between ballast lines and lamp lines over the entire operation range.

Figure 5:
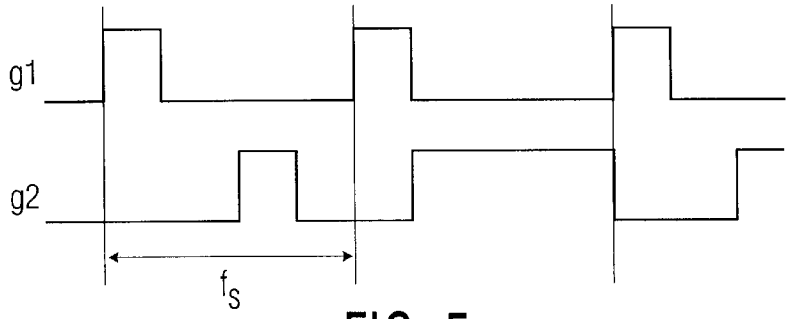
FIG. 5 shows mixed symmetric and asymmetric mode gate signals as incorporated in the present invention.
Figure 6:
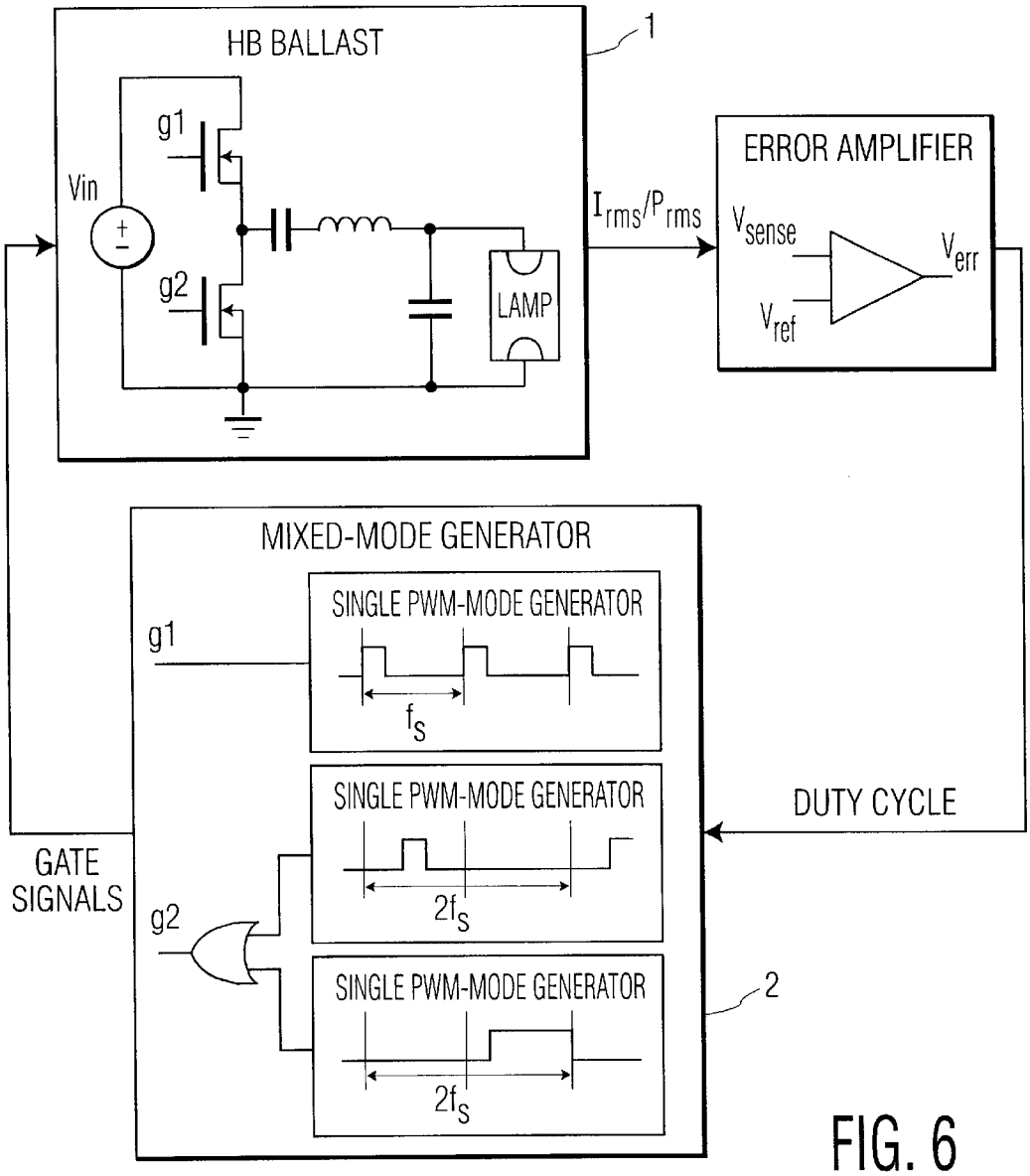
FIG. 6 shows the implementation block diagram of the mixed mode PWM gate signals as in FIG. 5.
Figure 7:
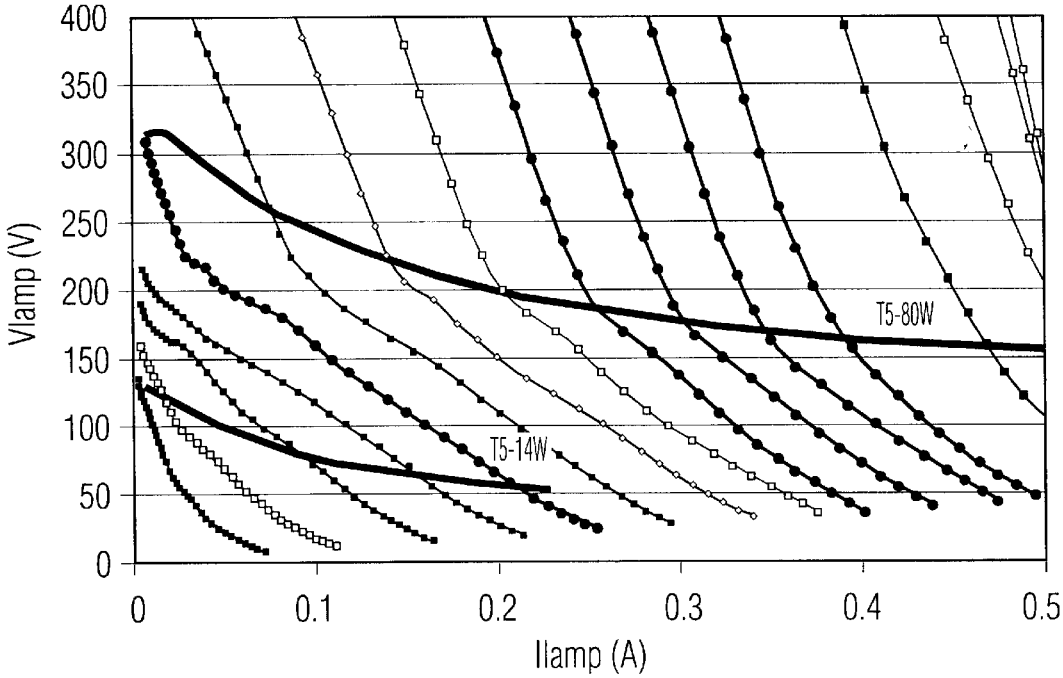
FIG. 7 shows the ballast lines and lamp lines with mixed symmetric and asymmetric mode control with the gate signals in FIG. 5.

As a preferred embodiment, a mixed-mode control is generated by alternating symmetric mode and asymmetric mode every other switching cycle, such as shown in FIGS. 5 and 6. The symmetric mode and asymmetric mode are arranged in an alternative pattern in switching cycles. The ballast curves resulting from such mixed-mode control is shown in FIG. 7, and only a single solution exists for both lamp type T5-80W and lamp type T5-14W. The characteristics of ballast lines can be improved since the lamp "sees" only the average effect at these high frequencies.

The controller 2 in FIG. 6 can be implemented by using discrete hardware, programmable logic device or software in a microprocessor for producing mixed-mode gate signals.

Even though FIGS. 5–7 illustrates a specific pattern of mixed-mode control, it shall be understood that other patterns of mixed-mode control are also possible as long as they result in a single solution between ballast lines and lamp lines over the whole operating range. For example, an alternating duty pattern can also achieve similar effects. Furthermore, the gate signals are not limited to pulse width modulation (PWM) signals, and the component modes are also not limited to symmetric and asymmetric modes. Therefore, the scope of the invention is solely determined by the accompanying claims.

What is claimed is:

1. A ballast for driving lamps, comprising:

a ballast circuit having a ballast impedance line for each duty cycle and having at least two switches, said switches being turned on and off in switching cycles by applying respective gate voltages so as to producing a stable driving voltage for said lamps;

a controller for generating gate signals associated with each of said switches respectively and transmitting said gate signals to said ballast circuit for activating or deactivating said gate voltages for each of said switches; and wherein said gate signals are of a first mode in some of said switching cycles and are of a second mode in other switching cycles, said first mode causing said ballast circuit to produce concave ballast impedance lines and said second mode causing said ballast circuit to produce convex ballast impedance lines.

2. The ballast of claim 1 wherein said ballast circuit is a half-bridge ballast circuit having two said switches.

3. The ballast of claim 1 wherein said controller is implemented as hardware separate from said ballast circuit.

4. The ballast of claim 1 wherein said controller is implemented as software in a microprocessor.

5. The ballast of claim 1 wherein said controller is implemented as a programmable logic device.

6. The ballast of claim 1 wherein said gate signals of said first mode and said gate signals of said second mode are generated and transmitted alternatively in every other of said switching cycles.

7. The ballast of claim 6 wherein said first mode is symmetric mode and said second mode is asymmetric mode.

8. The ballast of claim 7 wherein said gate signals are pulse width modulation (PWM) signals.

9. A controller for controlling a ballast circuit for driving lamps, said ballast having at least two switches being turned on and off in switching cycles by applying gate voltages thereon for producing a stable driving voltage for said lamps, said controller comprising:

a generating circuit for generating gate signals for activating and deactivating said gate voltages of said switches;

means for transmitting said generated gate signals to said ballast circuit;

wherein said gate signals are of at least two different modes in different switching cycles such that said ballast circuit is caused by said gate signals to have only a single solution between ballast impedance lines and lamp impedance lines for all duty cycles.

10. The controller of claim 9 wherein said gate signals are pulse width modulation (PWM) signals.

11. The controller of claim 10 wherein one of said at least two modes comprises a symmetric mode.

12. The controller of claim 11 wherein one of said at least two modes comprises a asymmetric mode.

13. The controller of claim 12 wherein said symmetric mode and said asymmetric mode signals are arranged alternatively in every other of said switching cycles.

14. A method of controlling a ballast circuit for driving lamps, said ballast circuit having at least two switches being turned on and off in switching cycles, said method comprising steps of:

generating gate signals of a first mode in some switching cycles and of a second mode in other switching cycles, said first mode causing said ballast circuit to produce concave ballast impedance lines and said second mode causing said ballast circuit to produce convex ballast impedance lines; and transmitting said gate signals to said ballast circuit for activating and deactivating a gate voltage for turning on or off each of said switches.

15. A method of claim 14 wherein said gate signals are pulse width modulation (PWM) signals.

16. The method of claim 15 wherein said first mode is symmetric mode and said second mode is asymmetric mode.

* * * * *